US008944340B2

(12) United States Patent
Constantine

(10) Patent No.: US 8,944,340 B2
(45) Date of Patent: Feb. 3, 2015

(54) ADJUSTER FOR TRACK-MOUNTING ASSEMBLY

(71) Applicant: Edward Constantine, Kansas City, MO (US)

(72) Inventor: Edward Constantine, Kansas City, MO (US)

(73) Assignee: Amsted Rail Company, Inc, Chicago, IL (US)

( * ) Notice: Subject to any disclaimer, the term of this patent is extended or adjusted under 35 U.S.C. 154(b) by 203 days.

(21) Appl. No.: 13/757,398

(22) Filed: Feb. 1, 2013

(65) Prior Publication Data

US 2014/0217192 A1 Aug. 7, 2014

(51) Int. Cl.
*E01B 9/66* (2006.01)
*E01B 9/02* (2006.01)

(52) U.S. Cl.
CPC ..... *E01B 9/02* (2013.01)
USPC ..... 238/282; 238/346; 238/341; 238/317

(58) Field of Classification Search
CPC ..... E01B 9/32; E01B 13/02; E01B 9/66; F16B 5/0225; F16B 5/025
USPC ..... 238/265, 266, 282, 331, 346, 341, 317, 238/297
See application file for complete search history.

(56) References Cited

U.S. PATENT DOCUMENTS

| | | | | |
|---|---|---|---|---|
| 1,781,251 | A * | 11/1930 | Schwendt et al. | 238/281 |
| 4,561,589 | A * | 12/1985 | Hixson | 238/297 |
| 2011/0068184 | A1 * | 3/2011 | Rademacher et al. | 238/282 |

* cited by examiner

*Primary Examiner* — Mark Le
(74) *Attorney, Agent, or Firm* — Andrew Wilford

(57) ABSTRACT

A mounting plate fixed to a longitudinally extending rail is secured by a plurality of bolts in a substrate. The mounting plate is formed at each bolt with an array of ridges. An adjuster plate formed with a vertically throughgoing transversely elongated slot through which the respective bolt extends has a lower face formed with an array of downwardly projecting generally complementary to the ridges of the mounting plate and an upper face formed with a central recessed seat defined between two longitudinally extending and parallel edges at a predetermined transverse spacing. A gauge plate formed with two parallel outer edges spaced apart by a distance substantially equal to the transverse spacing of the seat edges and with an eccentric circular hole of a diameter substantially equal to an outer diameter of the shank of the respective bolt that extends vertically through the circular hole fits in the seat.

5 Claims, 4 Drawing Sheets

ADJUSTER FOR TRACK-MOUNTING ASSEMBLY

FIELD OF THE INVENTION

The present invention relates to a rail-mounting assembly. More particularly this invention concerns an adjuster for such an assembly.

BRIEF DESCRIPTION OF THE DRAWING

The above and other objects, features, and advantages will become more readily apparent from the following description, reference being made to the accompanying drawing in which.

BACKGROUND OF THE INVENTION

Figure 1:
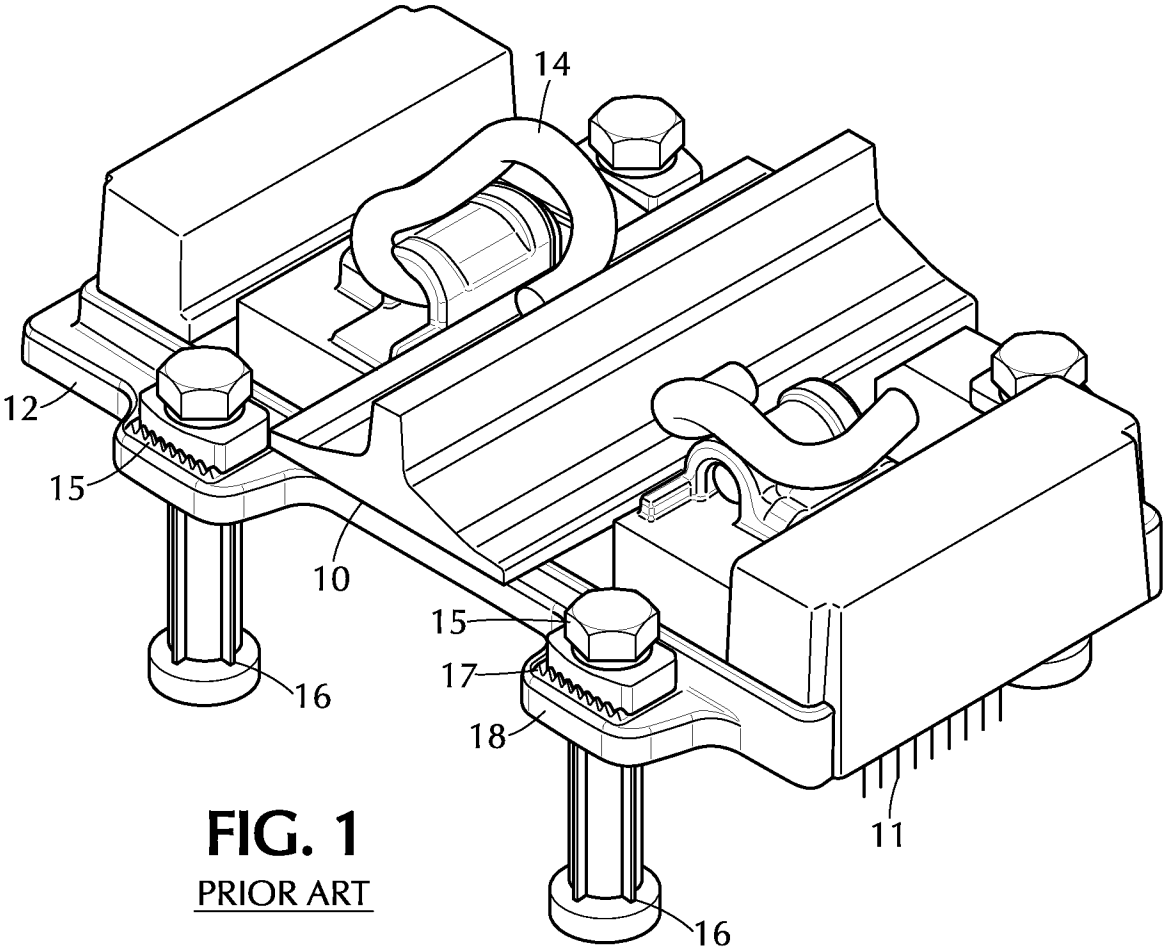
FIG. 1 PRIOR ART
FIG. 1 is a perspective view of a prior-art mounting assembly.
Figure 3:
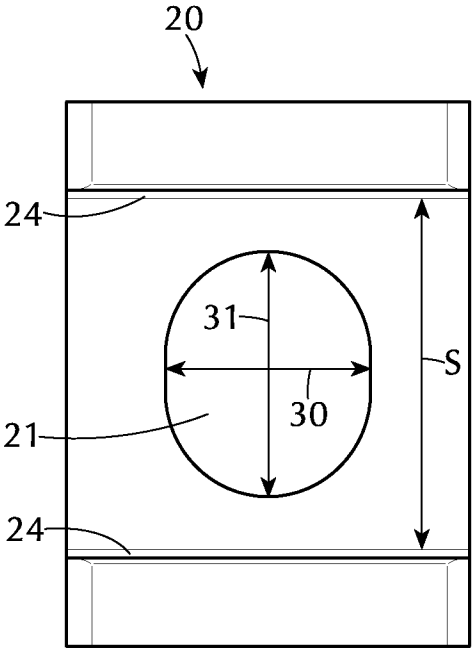
FIGS. 3, 4, and 5 are top, side, and bottom views of the ridge plate.
Figure 2:
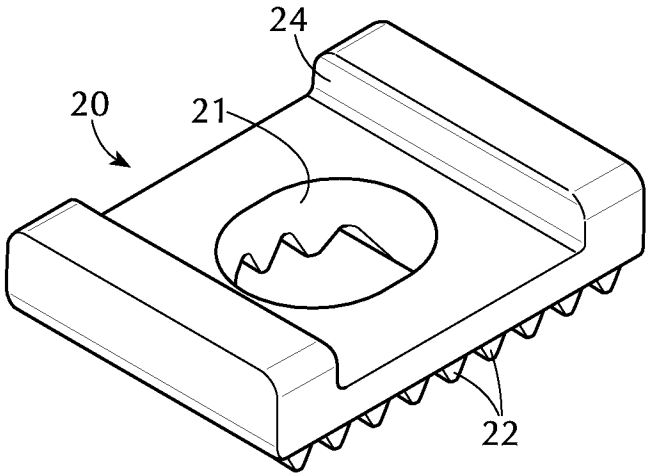
FIG. 2 is a perspective view of a ridge plate of an adjuster according to the invention.
Figure 5:
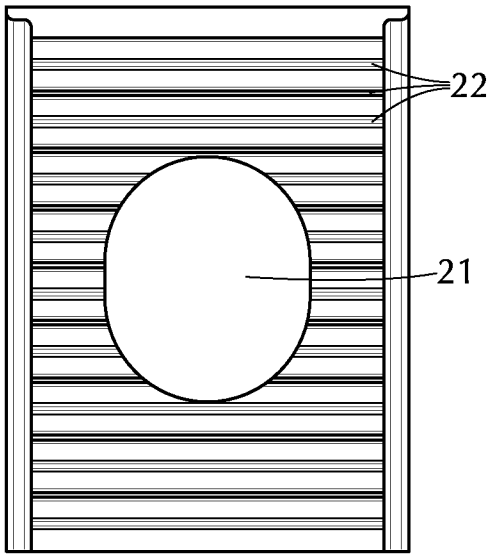
Figure 4:
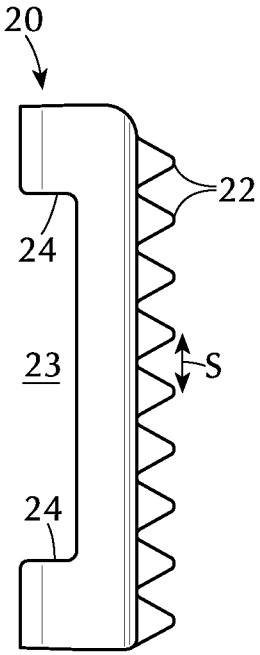

As disclosed in U.S. Pat. Nos. 8,065,826 and 8,210,444 and as shown in FIG. 1 a typical assembly for securing a railroad rail 10 to an underlayment 11, typically of concrete, comprises a generally flat mounting plate 12 and clips 14 holding the rail 10 down on the plate 12. The rail 10 is secured to the plate 12 very solidly such that the rail 10 cannot move transversely in direction T of its running direction relative to the mounting plate 12. This plate 12 is typically secured in turn by several bolts 15, normally four, that have shanks threaded into anchors 16 set in the concrete 11 and heads bearing downward via at least one washer on the plate 12.

Since the exact placement of the anchors 16 in the concrete underlayment 11 can never be perfect, the plate 12 is normally formed with short transversely extending slots through which the bolts 15 extend, allowing the mounting plate 12 to be positioned transversely before the bolts 15 are torqued down to lock the plate 12 in place.

Because of the enormous transverse forces that are exerted, in particular in nonstraight regions of the rail 10 at, for example, a turnout, it is necessary to provide something more than a simple frictional engagement of the bolt 15 with the mounting plate 12 to prevent transverse shifting of the plate 12 on the substrate 11 when, for instance a heavy high-speed train is passing.

Hence it is standard in the art to form the plate 12 at each of the bolts 15 with an array of longitudinally extending and upwardly pointing ridges 17 that are transversely uniformly spaced at, for example, 5-10 mm. Similarly the bolt 15 is fitted with an adjuster plate 18 having a circular central hole of a diameter only slightly greater than a diameter of a shank of the bolt 15, and formed with downwardly directed and longitudinally extending ridges 18 complementary to the ridges 17 of the plate 12. With such an arrangement when the bolt 15 is torqued down atop the adjuster plate 18, the interengaging teeth 17 and 18 and snug bore lock the plate 12 to the bolt 15, thereby creating an interfitting coupling that works on shear, not simply on friction. This solidly locks the plate 12 against transverse displacement relative to the bolts 15 fixed in the substrate 11.

This system has the disadvantage that with a modern high-speed train it is important to perfectly transversely position the rails relative to each other. The existing system only allows a relatively coarse indexing, typically in steps of 3.125 mm, that does not allow the rails to be positioned with the accuracy required for trains moving at speeds that are a multiple of what was once considered possible.

The obvious solution to this process is to provide more closely spaced ridges, but this does not work as such ridges are inherently smaller and subject to being sheared off if loaded transversely beyond a load that might be encountered when a train rounds a curve or passes through a turnout moving at high speed.

OBJECTS OF THE INVENTION

It is therefore an object of the present invention to provide an improved adjuster for a track-mounting assembly.

Another object is the provision of such an improved adjuster for a track-mounting assembly that overcomes the above-given disadvantages, in particular that provides a very fine degree of adjustment, yet that can withstand significant transverse thrust loads.

SUMMARY OF THE INVENTION

The instant invention is used in combination with a substrate to which a mounting plate fixed to a longitudinally extending rail is secured by a plurality of bolts anchored in the substrate. Each bolt has a cylindrical shank extending through the mounting plate and a head bearing downward on the mounting plate. The rail plate is formed at each bolt with an array of transversely uniformly spaced and upwardly projecting ridges.

Respective adjusters at each of the bolts each have according to the invention an adjuster plate formed with a vertically throughgoing transversely elongated slot through which the respective bolt extends and having a lower face formed with an array of downwardly projecting and transversely spaced ridges generally complementary to the ridges of the mounting plate and matable therewith and an upper face formed with a central recessed seat defined between two longitudinally extending and parallel edges at a predetermined transverse spacing. A gauge plate is formed with a first pair parallel outer edges spaced apart by a distance substantially equal to the transverse spacing of the seat edges and with a central circular hole of a diameter substantially equal to an outer diameter of the shank of the respective bolt that extends vertically through the circular hole. The gauge plate is fitted in the seat with its outer edges fitted to the seat edges and the circular hole vertically aligned with the slot of the adjuster plate. The circular central hole is offset centered on an axis offset from a midpoint equispaced between the outer edges of the first pair by a first offset equal to a fraction of a transverse ridge-to-ridge spacing of the arrays of ridges.

The gauge plate is of square shape and has a second pair of parallel outer edges. The axis is offset from a midpoint equispaced between the edges of the second pair by a second offset also equal to a fraction of the transverse ridge-to-ridge spacing and also different from the first offset.

The ridge-to-ridge spacing is between 6 mm and 7 mm and the offsets are at most 1 mm. More particularly, the ridge-to-ridge spacing is between 3 mm and 3.25 mm and the offsets are between 0.1 and 0.5 mm.

DETAILED DESCRIPTION

Thus the instant invention is as shown in FIGS. 2-7 a replacement for the standard one-piece plate 18. The invention is an adjuster comprising an adjuster plate 20 (FIGS. 2-5) formed with a vertically throughgoing transversely elongated slot 21 through which the respective bolt 15 extends and having a lower face formed with an array of downwardly projecting and transversely spaced ridges 22 of a V-section generally complementary to the ridges 18 of the mounting plate 12 and matable therewith. The width of the slot 21 corresponds closely to the diameter of the shank of the bolt 15. The plate 20 also has an upper face formed with a central recessed seat 23 defined between two longitudinally extending and parallel edges 24 at a predetermined transverse spacing S. The slot 21 has a width 30 (FIG. 3) equal to a diameter of the shank of the bolt 23 and a somewhat greater length 31, and a radius of curvature equal to the radius of the shank of the bolt 15.

Figure 7:
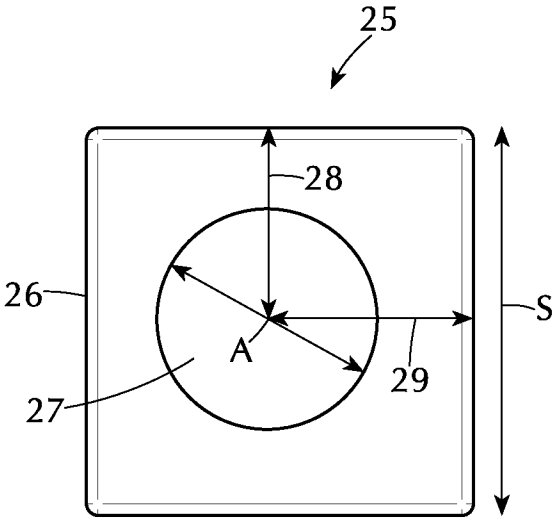
FIG. 7 is a top view of the gauge plate of FIG. 6.
Figure 6:
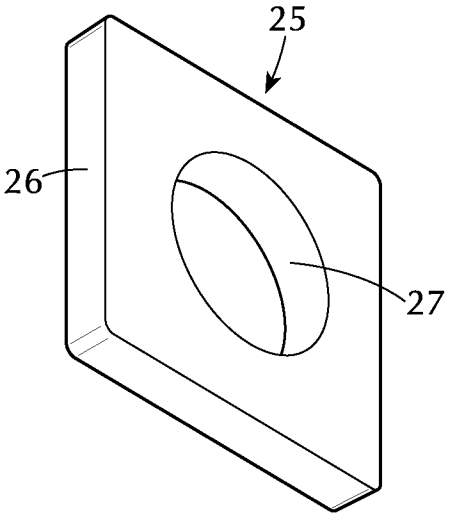
FIG. 6 is a perspective view of the gauge plate according to the invention used with the ridge plate of FIGS. 2-5.

According to the invention a square gauge plate 25 shown in FIGS. 6 and 7 is formed with two pairs of parallel outer edges 26 spaced apart by the transverse spacing S of the seat edges 24 and with a central circular hole 27 of a diameter D substantially equal to an outer diameter of the shank of the respective bolt 15 that extends vertically through the circular hole 27, so that the bolt 15 is a snug fit in the hole 27 and the gauge plate 25 is a snug fit between the seat edges 24. The gauge plate 25 is fitted in the seat 23 with its outer edges 26 fitted to the seat edges 24 and the circular hole 27 vertically aligned with the slot 21 of the adjuster plate.

According to the invention the circular central hole 24 is centered on an axis A offset from a midpoint equispaced between the outer edges 26. The axis A is offset in one direction from the edges 26 by a distance 28 and in a direction perpendicular thereto by a distance 29 different from 28.

More particularly according to a specific embodiment of the invention the dimensions are as follow:

Spacing s of the ridges 22 and 17=3.125 mm
Diameter D=23 mm
Dimension S of sides 26 and flanks 24=40 mm
Spacing 28=19.6 mm
Spacing 29=21.2 mm.
Slot width 30=23 mm
Slot length 31=27

With this system, therefore, with the four 90° offset positions of the gauge plate 20 it is possible to obtain four subdivisions of the 3.125 mm spacing of the ridges 22 and 17, namely in steps of 0.8 mm, making it possible to set the rail 10 at a very exact spacing.

In practice after the rail 10 and its plate 12 are exactly positioned, for example by use of a jig, a coarse adjustment of the position of the mounting plate 20 is done by fitting the ridges 22 of the plate 20 to the ridges 17. The bolt 15 is pushed through the hole 27 of the gauge plate 25, through the slot 21, and is threaded into the anchor 16, but left loose enough that the gauge plate 12 is above the plate 20 and can be rotated. Then a fine adjustment is effected by rotating the plate 25 for the best fit. Due to the 0.8 mm offset, in one position the fit will be good, far better than tolerances in fact require, and at that time the bolt 15 is torqued down to lock it in place.

I claim:

1. In combination with a substrate to which a mounting plate fixed to a longitudinally extending rail is secured by a plurality of bolts anchored in the substrate, each bolt having a cylindrical shank extending through the mounting plate and a head bearing downward on the mounting plate, the rail plate being formed at each bolt with an array of transversely uniformly spaced and upwardly projecting ridges, respective adjusters at each of the bolts and each comprising:

an adjuster plate formed with a vertically throughgoing transversely elongated slot through which the respective bolt extends and having a lower face formed with an array of downwardly projecting and transversely spaced ridges generally complementary to the ridges of the mounting plate and matable therewith and an upper face formed with a central recessed seat defined between two longitudinally extending and parallel edges at a predetermined transverse spacing; and a gauge plate formed with a first pair parallel outer edges spaced apart by a distance substantially equal to the transverse spacing of the seat edges and with a central circular hole of a diameter substantially equal to an outer diameter of the shank of the respective bolt that extends vertically through the circular hole, the gauge plate being fitted in the seat with its outer edges engaging the seat edges and the circular hole vertically aligned with the slot of the adjuster plate, the circular central hole being offset centered on an axis offset from a midpoint equispaced between the outer edges of the first pair by a first offset equal to a fraction of a transverse ridge-to-ridge spacing of the arrays of ridges.

2. The combination defined in claim 1, wherein the gauge plate is of square shape.

3. The combination defined in claim 2, wherein the gauge plate has a second pair of parallel outer edges, the axis being offset from a midpoint equispaced between the edges of the second pair by a second offset also equal to a fraction of the transverse ridge-to-ridge spacing and also different from the first offset.

4. The combination defined in claim 3 wherein the ridge-to-ridge spacing is between 6 mm and 7 mm and the offsets are at most 1 mm.

5. The combination defined in claim 4 wherein the ridge-to-ridge spacing is between 3 mm and 3.25 mm and the offsets are between 0.1 and 0.5 mm.

* * * * *